US005833549A

United States Patent [19]

Zur et al.

[11] Patent Number: 5,833,549

[45] Date of Patent: Nov. 10, 1998

[54] SPORTS TRAINER AND GAME

[75] Inventors: Oded Zur, Netanya, Israel; Douglas Schiller, Los Angeles, Calif.

[73] Assignee: Interactive Light, Inc., Santa Monica, Calif.

[21] Appl. No.: 557,855

[22] Filed: Nov. 14, 1995

[51] Int. Cl.[6] ..... A63B 71/02

[52] U.S. Cl. ..... 473/199; 473/152; 473/222; 473/453; 434/247; 434/307 R; 434/252; 463/36

[58] Field of Search ..... 473/131, 140, 473/150, 151, 155, 198–200, 219–223, 409, 415, 422, 451, 453, 457, 461; 364/410; 273/26 R, 148 R, 148 B; 463/36–37, 39; 434/247, 251, 252, 258, 307 R, 308

[56] References Cited

U.S. PATENT DOCUMENTS

| | | | |
|---|---|---|---|
| Re. 33,662 | 8/1991 | Blair et al. | 463/3 |
| 3,117,451 | 1/1964 | De La Verne Ray et al. . | |
| 4,136,387 | 1/1979 | Sullivan et al. | 473/200 |
| 4,150,825 | 4/1979 | Wilson | 473/152 |
| 4,306,722 | 12/1981 | Rusnak | 473/222 |
| 4,341,384 | 7/1982 | Thackrey | 473/222 |
| 4,342,455 | 8/1982 | Miyamae | 473/222 |
| 4,367,009 | 1/1983 | Suzki | 359/618 |
| 4,461,477 | 7/1984 | Stewart | 473/453 |
| 4,542,906 | 9/1985 | Takase et al. | 473/222 |
| 4,563,005 | 1/1986 | Hand et al. | 473/199 |
| 4,577,863 | 3/1986 | Ito et al. | 473/453 |
| 4,708,343 | 11/1987 | D'Ambrosio | 473/457 |
| 5,042,814 | 8/1991 | Bennett | 473/140 |
| 5,114,150 | 5/1992 | Matsumura | 473/222 |
| 5,471,383 | 11/1995 | Gobush et al. | 473/199 |
| 5,472,205 | 12/1995 | Bouton | 473/222 |
| 5,481,355 | 1/1996 | Iijima et al. | 473/199 |
| 5,501,463 | 3/1996 | Gobush et al. | 473/199 |
| 5,527,036 | 6/1996 | Hutchings et al. | 473/222 |
| 5,741,182 | 4/1998 | Lipps et al. | 463/36 |

FOREIGN PATENT DOCUMENTS 1190564 5/1970 United Kingdom .

*Primary Examiner*—Jessica Harrison
*Assistant Examiner*—Mark A. Sager
*Attorney, Agent, or Firm*—Kirschstein et al.

[57] ABSTRACT

An arrangement for use in training players of a game during a simulated game session in the correct use of a game implement that has to be moved properly during an actual game to encounter a ball and impart to the latter a desired trajectory of movement after impacting the same includes light-emitting devices that emit at least one initial and two subsequent detection light beams from locations arranged at the corners of a triangle into substantially vertically oriented upwardly conically diverging spatial sectors. A reflective surface associated with the implement reflects the light of the respective detection light beam back to the respective location as the implement passes through the respective spatial sector with an intensity that is in a predetermined functional relationship when reaching the respective location to the distance of the reflecting means from the same location and to the degree of penetration of the reflecting means into the respective spatial sector. Respective photosensors are provided at each of the locations and sense the intensity of the detection light returning to the location substantially only from the spatial sector after having been reflected from the implement as it moves through the respective spatial sector. The thus detected peak of the intensity of the returned light and the time at which such peak had occurred at each of the locations are then used to determine the respective distances of the implement from all of the locations and the times of passage thereof past such locations and from that various parameters of the movement of the implement including its speed and various angles assumed thereby while moving in a path above the arrangement towards a ball encounter location.

18 Claims, 4 Drawing Sheets

FIG 1
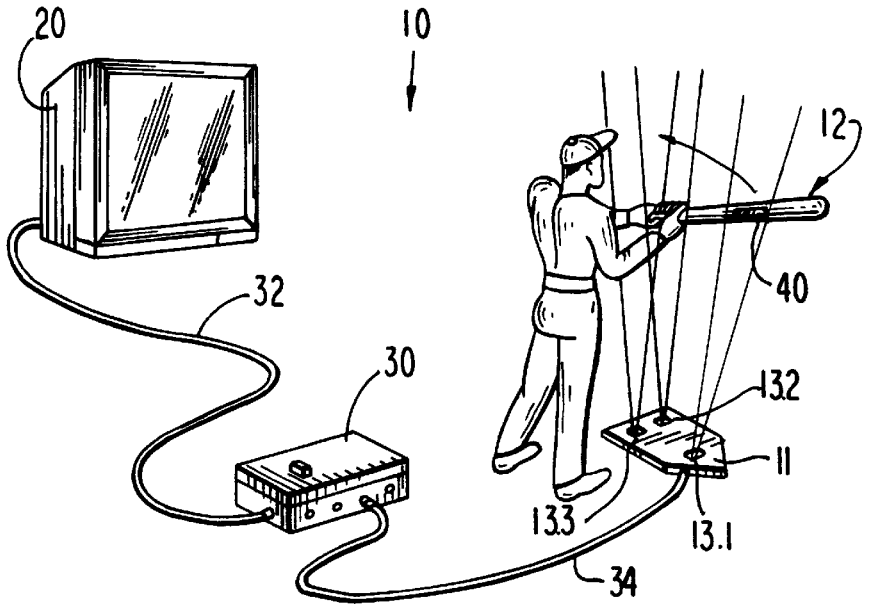
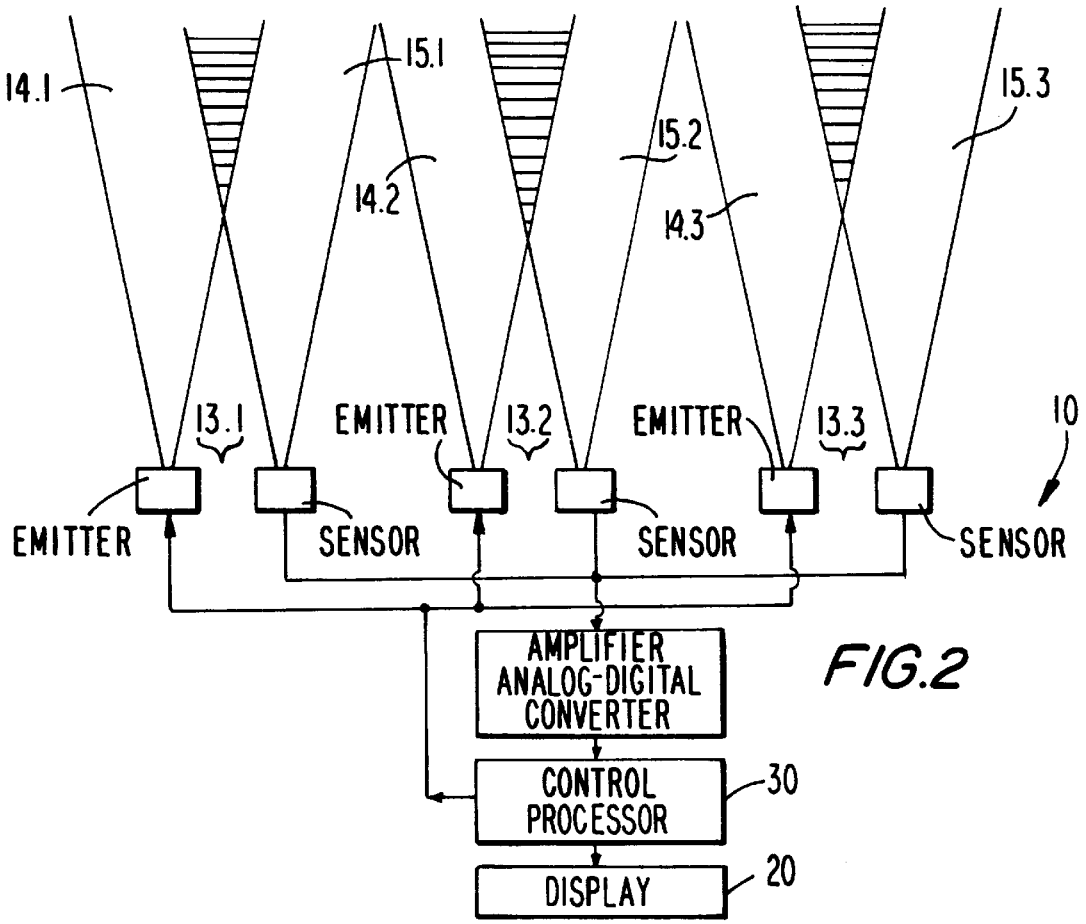
FIG.2

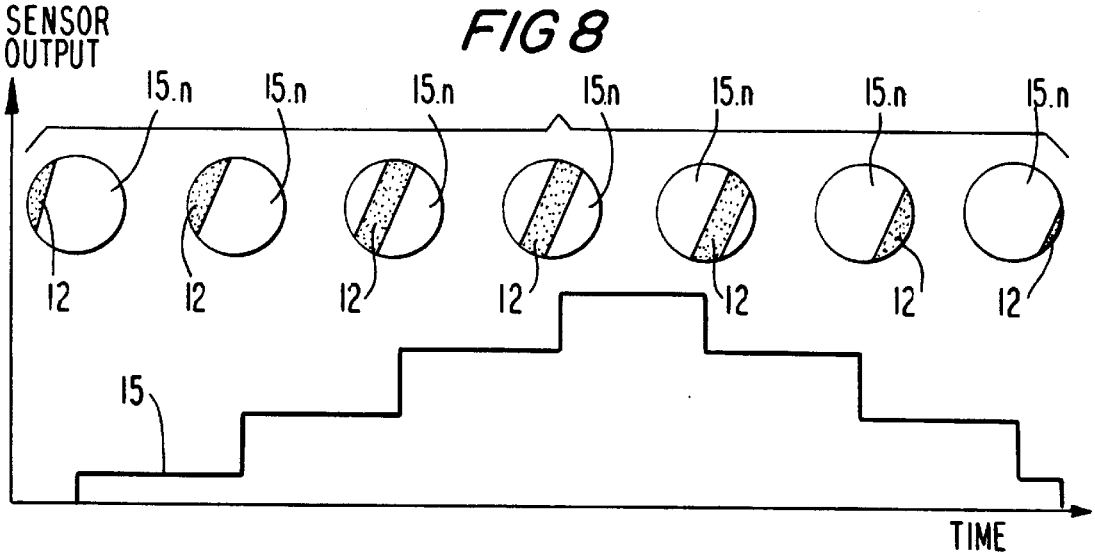
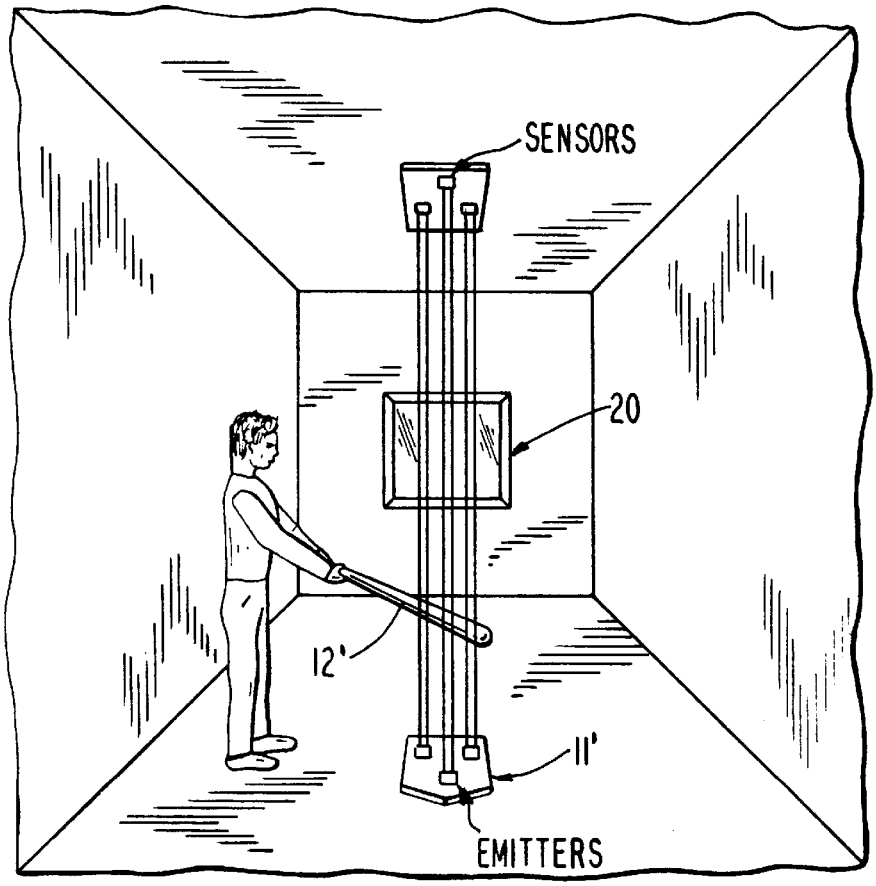
FIG.9

SPORTS TRAINER AND GAME

BACKGROUND OF THE INVENTION

1. Field of the Invention

The present invention relates to sports training equipment in general, and more particularly to an arrangement for detecting and evaluating the path and speed of movement of a game implement during a practice session or game toward encounter with an imaginary ball or analogous sports object.

2. Description of the Related Art

There are already known various constructions of arrangements that can be used for instance in baseball batting, golf club swinging, or similar game or sports practice for detecting the path and/or speed or movement of a game implement, such as a baseball bat or a golf club. It is quite common in this environment to use light reflected from a moving game or sports implement as the medium carrying the messages or information about the momentary position of the implement to a light sensor or a light sensor array. Arrangements of this type and/or devices and features that may be used in arrangements of this type are disclosed in U.S. Pat. Nos. 3,117,451 to Ray; 4,150,825 to Wilson; 4,306,722 to Rusnak; 4,341,384 to Thackrey; 4,367,009 to Suzki; 4,461.477 to Stewart; 4,577,863 to Ito and 4,708,343 to D'Ambrosio; and in the British Pat. No. 1,190,564 to Bottomley.

While the game implement movement monitoring or training arrangements disclosed in some of the above-identified references are quite sophisticated and should, at least in theory, work well, the fact remains that they have not gained widespread acceptance among those entrusted with training players of the particular games at various levels of skill, and certainly not by the general public. It is believed that one reason for this lack of an enthusiastic response to such arrangements, besides the relatively high and sometimes even prohibitive cost of such equipment, is the rather limited amount of information that can be collected by such equipment and the attendant limited usefulness of the equipment for finding out what exactly went wrong during a particular implement swing and what should be done the next time to improve the implement handling.

So, for instance, in the Ray reference, a reflector provided at the end of a bat is used to reflect light from a light source to any member of an array of photosensitive elements. The path of movement of the bat can be followed based on which of such elements receives or receive such reflected light. In this arrangement, however, most of the parameters that determine the path of movement of the ball after being struck by the game implement go undetected, so that the usefulness of this arrangement for training purposes is quite limited.

Similarly, in the arrangement of the Ito reference, the only parameter that is being detected is the distance of the game implement during its swinging motion from four light transmitter/receiver (transceiver) devices, such devices being paired with one another so that the input from both of the devices in each of such pair is needed to calculate the respective distance. Here again, since the distance at which the game implement moves above the ground is merely one parameter in determining the trajectory of the ball after impact with the implement, the usefulness of this arrangement is severely compromised.

OBJECTS OF THE INVENTION

Accordingly, it is a general object of the present invention to avoid the disadvantages of the prior art.

More particularly, it is an object of the present invention to provide a game or training arrangement which does not possess the drawbacks of the known arrangements of this kind.

Still another object of the present invention is to devise a game training arrangement of the type here under consideration which renders it possible to collect a sufficient amount of data of different kinds descriptive of the path and speed of movement of the implement to be able to reliably predict the trajectory of an imaginary ball after having been impacted by the implement in a simulated game.

It is yet another object of the present invention to design the above arrangement in such a manner as to provide an accurate set of measured values from which such ball trajectory can be reliably determined.

A concomitant object of the present invention is so to construct the arrangement of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an arrangement for use in training players of a game during a simulated game session in the correct use of a game implement that has to be moved properly during an actual game to encounter a ball and impart to the latter a desired trajectory of movement after impacting the same. The arrangement also serves as an amusement device whereby a player can simulate a sports activity in the privacy of one's home.

In its broadest aspect, the arrangement is operative for determining the path and speed of movement of a moving implement, and comprises a support; means on the support for generating an optical spatial sector extending away from the support along a longitudinal direction, and having a cross-sectional dimension along a transverse direction normal to said longitudinal direction, said cross-sectional dimension being known along the longitudinal direction; and means for optically detecting the longitudinal distance of the moving implement relative to the support and the speed of the moving implement through the spatial sector, said detecting means including means for determining an entry time when the implement entered the spatial sector, an exit time when the implement exited the spatial sector, and an intensity of light corresponding to the longitudinal distance relative to the support.

In one embodiment, reflecting means are associated with the implement, and the detecting means includes photosensitive means on the support for sensing the intensity of light reflected by the reflecting means. The determining means is operative for determining the peak of the intensity of the reflected light. The peak intensity corresponds to the longitudinal distance of the implement relative to the support.

In another embodiment, the detecting means includes photosensitive means remote from the support for directly receiving a light beam. The determining means is operative for determining the valley of the intensity of the light received by the photosensitive means. The valley intensity corresponds to the longitudinal distance of the implement relative to the support.

More particularly, the arrangement includes light-emitting means for emitting at least one initial and at least one, but preferably two, subsequent detection light beams from locations arranged at the corners of a triangle into substantially vertically oriented upwardly conically diverging spatial sectors. The reflecting means is associated with or on the implement for reflecting the light of the respective detection light beam back to the respective location as the implement passes through the respective spatial sector with an intensity that is in a predetermined functional relationship when reaching the respective location to the distance of the reflecting means from the same location and to the degree of penetration of the reflecting means into the respective spatial sector. The photosensitive means at each of the locations is operative for sensing the intensity of the detection light returning to the location substantially only from the spatial sector after having been reflected from the reflecting means during the passage of the implement provided with the same through the respective spatial sector. The determining or evaluating means is operative for detecting the peak of the intensity of the returned light for use in determining the respective distances of the implement from all of the locations, as well as the entry, exit and passage times past such locations, and from that various parameters of the movement of the implement including its speed and various angles assumed thereby while moving in a path above the arrangement towards a ball encounter location.

A particular advantage of the arrangement as described so far is that the data collected thereby is sufficient to describe not only the various angles the implement assumes as it moves in space during the critical phase of its movement, but also the location of the movement path in space and the speed of movement of the implement. These parameters are then sufficient to determine the impact the encounter with the moving implement would have on a ball in an actual game. This makes this arrangement eminently suitable for training players of the game to improve their technique in a simulated environment, that is, without actually hitting the ball.

A particularly advantageous aspect of the present invention is achieved when the light-emitting means is operative for emitting the light beams intermittently and in a predetermined sequence during a cycle of operation of the arrangement. The evaluating means includes means for holding the value of the measured intensity until the returned light intensity is measured again during the next following cycle. In this context, it is further advantageous when the evaluating means further includes means for comparing the values of the measured intensity for each successive two of the cycles, and issuing a signal representative of the immediately previously measured light intensity once the comparison indicates a decrease in the measured intensity value.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying.

BRIEF DESCRIPTION OF THE DRAWING

FIG. 1 is a perspective view of one embodiment of a game or training arrangement of the present invention in its condition of use;

FIG. 2 is a schematic block diagram of some of the electronic components of the arrangement of FIG. 1;

FIG. 8 is a diagrammatic view illustrating at its upper portion a time-development representation of the degree of game implement visibility in the vision field of one photosensitive element of the arrangement of FIGS. 1 to 7, and at its lower portion a corresponding graphic representation of the dependence on the output signal level of the one photosensitive element over time; and FIG. 9 is a perspective view of another embodiment of the game or training arrangement of the present invention.

DETAILED DESCRIPTION OF THE PREFERRED EMBODIMENT

Figure 3:
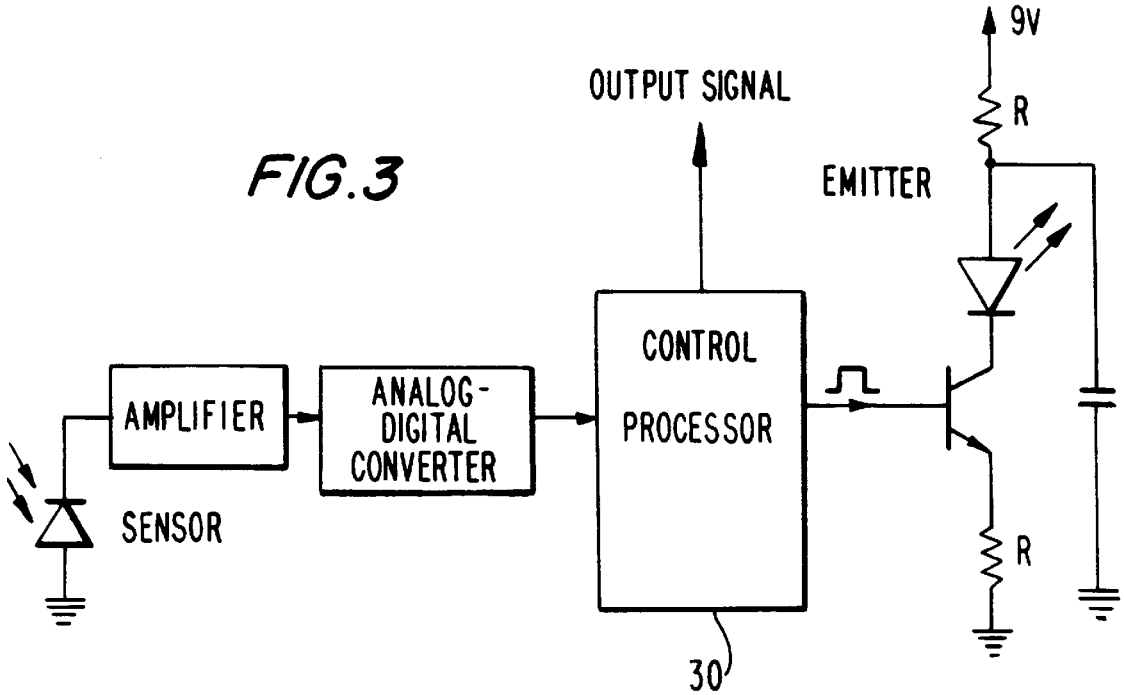
FIG. 3 is an electrical circuit schematic of part of FIG. 2.
Figure 4:
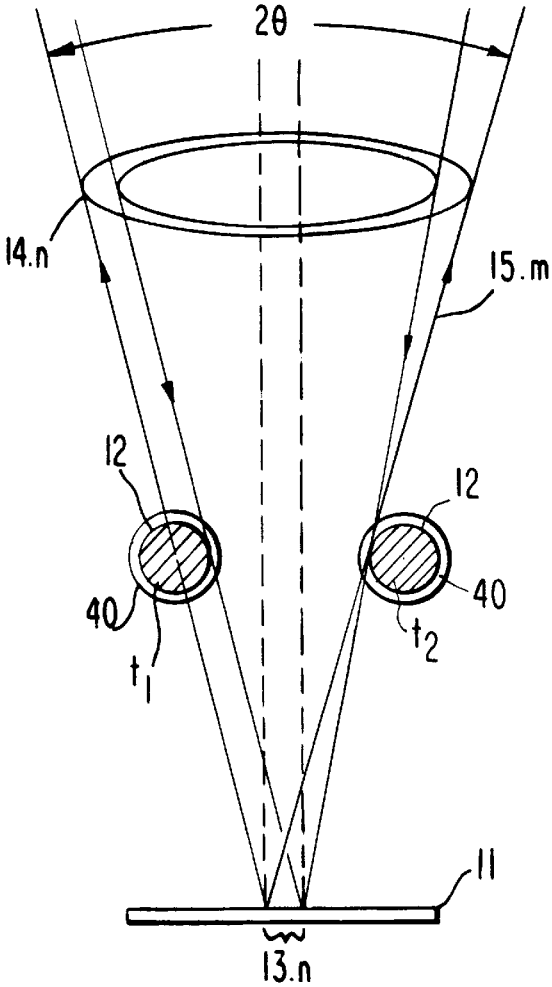
FIG. 4 is a sketch showing various parameters determined by the arrangement.

Referring now to the drawing in detail, and first to FIG. 1 thereof, it may be seen that the reference numeral 10 has been used therein to identify a game training arrangement of the present invention in its entirety. The game training arrangement 10 will be discussed herein as being configured and used for the purposes of training a baseball player, namely of improving his or her performance at bat. However, it is to be understood that the present invention can be used, with only minor modifications, if any, for training not only baseball players, but also golfers and players of other sports or games in which the proper handling of what will be referred to herein as a "game implement", e.g., a bat, a club, a racquet or a similar hand-held element used to hit or otherwise contact a ball or a similar moving or stationary object, is an important factor in the successful performance of the player in the game.

The illustrated training arrangement 10 constitutes a part of an overall system that is known as to its basic tenets and hence not, as such, the subject of the present invention; therefore, this system will be described herein only to the extent deemed to be necessary for proper understanding of the present invention.

As revealed in some of the references cited above, the training arrangement 10 of the present invention includes a display arrangement 20, such as a movie projection screen, a television receiver, a monitor screen or the like. The display arrangement 20 is typically used to prompt the player, e.g., to begin his or her swing, either with text or visually by displaying the progress of a ball image as it approaches the batter in training. The system also includes an evaluation and/or control arrangement 30 that evaluates information gathered by the training arrangement, usually correlates it with information describing the path of movement of the ball as presented on the display arrangement prior to and during the respective batter's swing, and presents results that are representative of the batter's performance, usually in terms of where the ball, the movement of which was displayed on or by the display arrangement in this simulated game, would have gone and would have landed in real life. Of course, for such evaluation to be valid, the basic components of the system have to be in communication with one another, be it through respective wire connections 32 and 34, via short-distance radio transmissions, or the like.

The training arrangement 10 includes a low profile support or housing 11 that rests on the ground. The housing 11 should not rise too much above the ground when in use (especially when used to teach the proper golfing strikes). The housing could be round, triangular, hexagonal, oval, or any other desired shape as seen from above in its position of use. In the baseball training application described here, it is currently preferred, for practical as well as aesthetic reasons, to give the housing 11 a configuration reminiscent of that of a home base plate.

As mentioned before, the training arrangement 10 is to be used to collect information concerning the movement of a game implement (in the given example, a baseball bat) 12 during a movement thereof that simulates its movement during an actual play or game toward encounter with an approaching (in the case of golf or similar games, stationary) ball or other flying object, such as a shuttlecock. To this end, the training arrangement is equipped with at least one, and preferably a plurality of detecting devices 13.1 to 13.n, wherein n is any desired positive integral number. In the illustrated example, there are three of such detecting devices designated as 13.1 to 13.3, which is currently considered to be an optimum number for obtaining a set of results completely and reliably describing the behavior of the bat 12 or similar game implement during its aforementioned swinging or striking movement. The use of an additional one or more of such detecting devices 13.1 to 13.n (in a rectangular or trapezoidal array with the other devices 13.1 to 13.3) is also currently being contemplated.

As best seen in FIGS. 2 and 3, each of the detecting devices 13.1 to 13.n is constructed as a doublet or transceiver that includes an emitter of light, preferably in the infrared range, and a sensor or photodetector that is sensitive to the light emitted by the light emitter but preferably to no other light, especially to ambient light. Devices of this type are well known so that they need not be described here in any detail. For example, reference may be had to U.S. Pat. Nos. 5,045,687; 5,369,270; 5,414,256; 5,442,168; 5,459,312; as well as to allowed U.S. patent application Ser. No. 08/248,434, filed May 24, 1994 and No. 08/376,113, filed Jan. 20, 1995, for further descriptions of suitable transceivers. All of said patents and applications are owned by the assignee of the instant application, and their disclosures are hereby incorporated by reference herein. Suffice it to say that the emitter may be a light-emitting diode (LED) or even a laser, and that the photosensitive element or detector may as such be sensitive over a wide range of wavelengths, but its sensitivity may be restricted to generally coincide with or embrace at least one wavelength issued by the emitter by interposing a filter ahead of it as considered in the direction of propagation of light toward its photosensitive sensor region.

As a comparison of FIG. 1 of the drawing with FIGS. 2 through 7 will indicate, the devices 13.1 to 13.3 are accommodated in the interior of the housing 11 in the illustrated embodiment of the present invention. The light emitters of the devices 13.1 to 13.3 issue respective light beams into emission spaces that are indicated in the drawing in phantom lines as 14.1 to 14.3. Such emission spaces 14.1 to 14.3 diverge, basically in a conical fashion from their points of origin at the emitters of the devices 13.1 upwardly, at an angle θ from a line substantially perpendicular to the plane along which the major dimensions of the housing 11 extend (so that the overall spatial angle occupied by the respective space such as 14.1 amounts to 2θ). See FIG. 4, wherein representative device 13.n generates a conical space 14.n of overall spatial angle 2θ0.

The spaces 14.1 to 14.3 are also substantially coincident with and overlap those constituting the fields of view or vision 15.1, 15.2, 15.3 of the respective photodetectors of the devices 13.1 to 13.3. Again, see FIG. 4, wherein representative field of vision 15.n is substantially coincident with space 14.n. Although the vision field 15.n is shown as being entirely within the space 14.n, the reverse could be true. In either event, the overlapping region, also known as a spatial sector, occupies a volume of space having a known configurational size. As a result of this, any of the light originating in the light-emitting part of a respective one of the devices 13.1 that illuminates the bat 12 as it moves through the respective one of the overlapping spaces 13.1 to 13.3 and fields of vision 15.1, 15.2, 15.3 and is reflected back from it, will reach the very same device 13.1 to 13.3 and be detected by its photosensitive part, whereas any stray scattered radiation bounced from the bat 12 will not be able to reach the photosensitive part of any other of the detecting devices 13.2, 13.3 or 13.1, respectively, since it would propagate toward it from a direction outside its field of vision that coincides with the respective associated space 14.2, 14.3 or 14.1.

It is currently preferred to maximize the amount of light that is retroreflected from the bat 12 as it passes through the respective space 14.1, 14.2 and/or 14.3 by providing the bat 12 with a highly reflective surface, or all over, or at least on a predetermined surface region. A currently preferred way of obtaining this high reflectivity is to use an aluminum bat, or to apply a type 7160W reflective tape 40 manufactured by the Minnesota Mining and Manufacturing company to the affected region of the bat 12. Using this particular tape 40 has the additional advantage that the intensity of the light that is reflected from the tape back to the respective transmitter/receiver doublet 13.1, 13.2 or 13.3 is directly proportional to the distance of the bat 12 from the housing 11 and to the area of the tape that is within the transmitted beam and within the vision field 15.1, 15.2, 15.3 of the photosensitive receiving part of the respective doublet 13.1, 13.2 or 13.3, that is, within the spatial angle 2θ.

It would also be possible to use a regular colored (non-reflective) surface of the bat 12 itself or of a coating, layer, or tape applied thereto for returning the emitted sensing light back to the respective transceiver 13.1, 13.2 or 13.3, with similar results as far as the proportional dependence of the returned light energy on the distance of the bat 12 from the housing 11 is concerned, but then the distance over which the arrangement 10 would be able to discern would be much shorter.

Furthermore, using different distances between the IR transmitter part and the IR receiver part of the respective transceiver 13.1, 13.2 or 13.3, and using different types of reflective tapes, than described above, may result in a reflected energy that is not proportional to the distance of the implement or bat 12 from the housing 11. While this can be taken into account in the evaluation, by using properly calibrated lookup tables or translation algorithms, the currently preferred approach is that described initially, that is, that using a reflective tape that gives the proportional dependence of the reflected light intensity as a function of the distance from or elevation above the housing 11.

Figure 7:
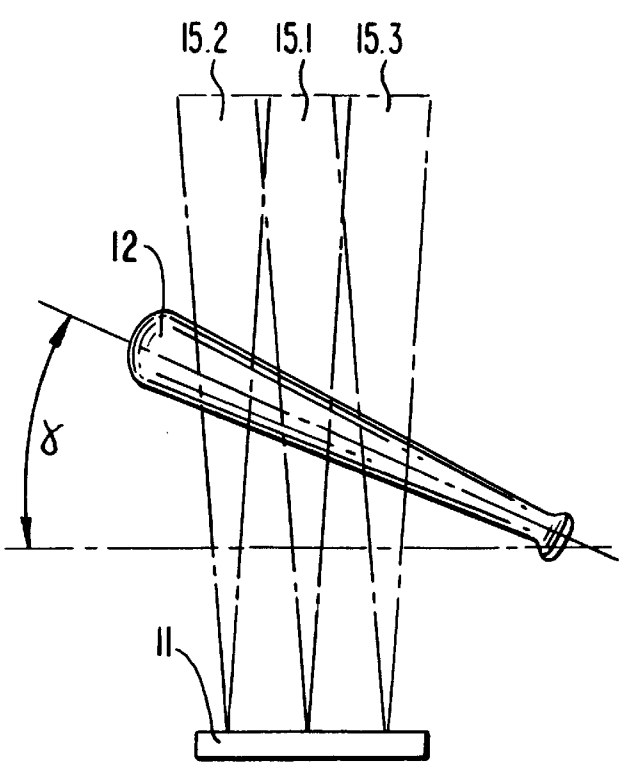
FIG. 7 is a front elevational view of the part of the training arrangement of FIGS. 4 and 5, in its use condition as well.
Figure 6:
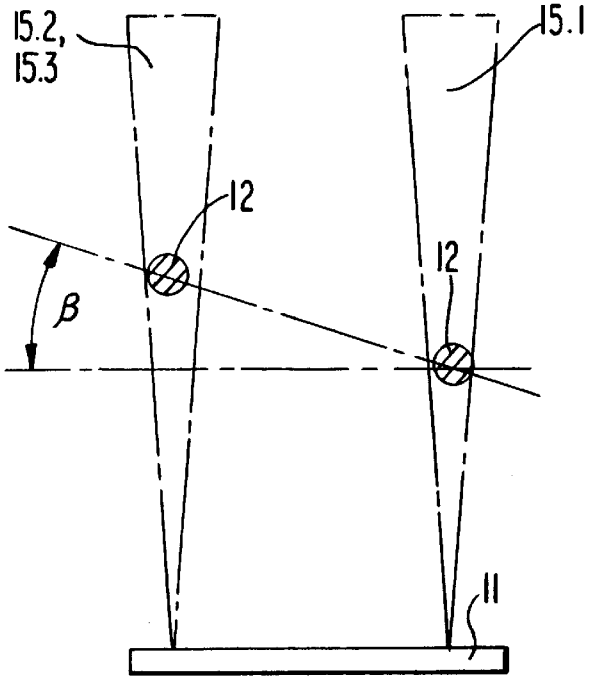
FIG. 6 is a side elevational view of the part of the training arrangement of FIG. 5.

Having so described the basic construction of the arrangement 10, its operation will now be discussed in some detail, initially still with reference to the simplified FIGS. 5 to 7 of the drawing considered in conjunction with one another. As depicted there, the baseball bat 12 (held in the hands of a player, not shown) may assume different positions relative to and above the housing 11 of the training arrangement. As a matter of fact, the bat is caused by the player to move above the housing 11 in a trajectory (from right to left in FIGS. 5 and 6, from back to front in FIG. 7) and at a speed chosen by the player in an attempt to hit the aforementioned image simulating an actual ball approach in a manner which, if a real ball were involved, would send that ball to a region of the playing field chosen by the player.

Of course, like in a real game, the intentions of the player and the achieved result may differ drastically; yet, like in real life, so in the simulated game, the path in which, and the distance to which, the ball travels or would travel are unequivocally determined by several parameters: the point at which the ball and the bat 12 meet each other, any spin that the ball may have, the speed at which it travels toward the batter, the speed at which the bat 12 travels in its trajectory just prior to meeting with the ball, an angle $\alpha$ that the bat 12 encloses with a normal to the direction of the pitch, an angle $\beta$ that the trajectory of travel of the bat 12 encloses with the horizontal, and an angle $\gamma$ that the bat 12 encloses with the horizontal at the time of impact. Those of the above variables that are related to the ball, such as its path of travel, its speed, and its spin, must be guessed or evaluated by the player of the simulated game in the same manner as they would be in a real game depending on the visual input to the player (i.e., the projected image of an approaching ball or the like), whereas those relating to the bat (i.e., its speed and the angles $\alpha$, $\beta$ and $\gamma$) are chosen by the player based on experience and, in some instances, personal habits or preferences, in the simulated game the same as they would be in a real game.

Thus, it may be seen that the arrangement 10 enables the player to have batting practice almost anywhere, and not necessarily on the actual baseball field. To do that, though, the arrangement 10 by itself or in cooperation with the other aforementioned components of the training arrangement must be capable of providing the player with an accurate, preferably instantaneous, feedback as to the results of the action taken, that is where the ball would have landed in an actual game. For this desired high degree of real-time accuracy to be achieved, it is imperative that the measurements taken by the arrangement 10 (that is, by each and every one of its transceiver devices 13.1, 13.2 and 13.3) be as accurate as possible within the realm of feasibility, both as to the distances being measured and the time of the passage of the affected portion 40 of the bat 12 through the vision fields 15.1 to 15.3 of the detection devices 13.1 to 13.3.

One way in which such accurate distance measurement can be accomplished in accordance with the present invention is indicated in FIG. 8 of the drawing. As shown there, respective successive "snapshots" of the bat 12 (or its affected, i.e. reflecting, region) are taken at predetermined intervals. As a matter of fact, for the sake of simplicity, such snapshots are taken at regular intervals of the respective vision field 15.n, whether or not the bat 12 is in it at the particular time that the snapshot is taken. One way in which such snapshots can be obtained is by pulsing or strobing the infrared light emanating from the light-emitting part of the respective doublet 13.n. However, it is also possible for such light-emitting part to issue its light on a continuous basis, and to achieve the snapshot effect by sampling the intensity of the infrared radiation returning to the respective doublet 13.n after having been reflected from the bat 12 or its affected region.

Examples of the aforementioned snapshots taken as the bat 12 moves through the respective vision field 15.n are shown in the upper part of FIG. 8, whereas its lower part shows a graphic representation of the received reflected light intensity as it changes from one snapshot to another, first going up and than going down again as the area of the vision field "obscured" by the bat 12 or its affected (reflecting) region initially increases and subsequently decreases. Regardless of whether the snapshot is the result of pulsing the light source or sampling the electrical output signal of the respective photosensitive element that corresponds to the intensity of the returned radiation, it has been found to be advantageous for the sampled level of the electrical output signal to be held at the measured value of the particular sample until the value of the next successive sample is determined. This approach employs a control processor 30 (see FIG. 3) comprised of electrical or electronic components and circuitry that are well known to those versed in the electrical field. For example, reference may be had to the above-identified patents and allowed applications for details of the control processor, as well as to another allowed U.S. patent application Ser. No. 08/297,266, filed Aug. 26, 1994, also incorporated by reference herein, for details of a suitable control processor whose output signal is proportional to the intensity of the detected light.

This approach results in the stepped behavior of the measured parameter (usually the voltage of the output signal of the photosensitive element) that is depicted in FIG. 8 at 15, rendering it easy to determine not only the peak value of such parameter by comparing the successive step values and recording the latest value achieved before the parameter value started to decrease, but also the effective time such peak value was reached, be it the beginning or the end of the respective preceding measuring time period or any point in time in between, so long as such point in time is chosen in a consistent manner for each of the detecting devices 13.1 to 13.n. Of course, the precision with which the value of the respective parameter, that is light intensity or time, is determined depends on the relative dimensions of the successive steps which, in turn, are determined by the sampling rate: the higher this rate, the more of the steps in a given time, the lesser the magnitude of the intensity increments from one step to another, and ultimately the lesser the likely deviation of the actual peak intensity value from the highest measured intensity value.

However, there is a point of diminishing returns beyond which any advantages obtained from increasing the precision by reducing the size of the steps are more than outweighed by the effect of other factors, such as fluctuations in the intensity of the issued light, possibility of interference from stray radiation from other sources, and even those relating to the complexity and longevity, and hence cost, of the equipment. In view of this, it is currently preferred to use in the respective devices 13.1 to 13.n IR radiation sources that are capable of being rapidly turned on to full capacity and off again, and to activate them one after another in a predetermined sequence, such that only one of them issues any meaningful amount of light at any given time. Very good results have been obtained by cycling though three light sources once every 60 $\mu$secs (microseconds), and activating each of them for about 3 $\mu$secs each time its turn comes up, with a pause intervening between each successive two of the ensuing light pulses. The pause includes a 15 $\mu$secs waiting time to measure the returning light and a 2 $\mu$secs evaluation time. This, of course, means that the length of each step expressed in time terms is 60 $\mu$sec, and so is the maximum amount of inaccuracy in the determination of the time at which the intensity of the reflected light has actually peaked.

It will be appreciated that this relatively short cycling time also keeps the size of the detected intensity increments, and hence the maximum inaccuracy in the detection of the actual maximum intensity, relatively small, merely a minuscule fraction of the parameter being measured, i.e., the intensity or power of the IR radiation that is reflected from the bat or similar game or sports implement 12. This means that this inaccuracy has only a negligible, if any, effect, on the accuracy of the end result of the determination process, i.e.

the value of the distance from the respective device 13.n at which the implement 12 passes through the associated vision field 15.n. It may be perceived from observation of the upper portion of FIG. 8 of the drawing that the area of the implement 12 that is visible to the respective device 13.n at any time (and hence the intensity of the light reflected from the implement 12 and reaching the device 13.n) increases as the implement 12 approaches the centerline of the vision field (irrespective of the angles α, β and γ) and decreases as it subsequently moves away from such centerline, i.e., with the "visible length" of the implement.

It goes without saying that the detected reflected light intensity also depends on the "visible width" of the implement 12 (or of its reflecting region). This variable, though, is a function of the distance of the implement from the respective device 13.n (the greater the distance, the smaller the spatial angle occupied by the implement 12 within the field of view 15.n when the implement 12 is fully visible within the respective vision field 15.n), so that the intensity of the detected returning radiation is inversely proportionate to the distance of the implement 12 from the device 13.n, again irrespective of the angles α, β and γ. This, of course, presupposes that the spatial distribution of the IR radiation reflected (or scattered) from the implement 12 is substantially uniform over the contemplated ranges of such angles; this, however, can be quite easily accomplished in the manner mentioned before, i.e., by using the appropriate kind of reflective tape 40 of the like on the affected region of the implement 12.

Once the requisite parameters (i.e., the distance, that is the height of passage of the implement 12 over the housing 11, on the one hand, and the time of passage of the implement 12 through the respective vision field 15.n, on the other hand) have been determined with the required degree of precision for each of the three transceiver devices 13.1, 13.2 and 13.3, the next step is to calculate the speed of the implement 12 and its trajectory of movement. Once these values are known, they can be used in a manner that will be discussed later to predict the trajectory of the fictitious ball after its encounter with the implement 12.

The trajectory parameter and speed calculations are made using the following equations:

$$H = \frac{H1 + H2 + H3}{3}$$

$$V = \frac{2Y}{T1 + T2}$$

$$\tan\beta = \frac{\frac{H2 + H3}{2} - H1}{Y}$$

$$\tan\alpha = \frac{(T2 - T1)V}{X}$$

$$\tan\gamma = \frac{H2 - H3}{X}$$

wherein H1, H2 and H3 are the heights of the implement 12 above the respective devices 13.1, 13.2 and 13.3 as determined from the measured intensities using either lookup tables or an approximation function, H is the average height, X is the distance between the centers of the photosensors of the devices 13.2 and 13.3, Y is the distance between the line connecting the centers of the photosensors of the devices 13.2 and 13.3 and the center of the photosensor of the device 13.1, T1 is the time elapsed between the passage of the implement 12 above the centers of the photosensors of the devices 13.1 and 13.2, T2 is the time elapsed between the passage of the implement 12 above the centers of the photosensors of the devices 13.1 and 13.3, V is the average speed of the implement 12, α is the azimuth angle of the implement 12 as it passes by the devices 13.2 and 13.3, β is the elevation angle of the trajectory of the implement 12 as it moves from the device 13.1 to the devices 13.2 and 13.3, and γ is the inclination angle of the implement 12 (bat) as it moves in its trajectory.

It will be appreciated that, while the factors that determine the path of the ball (actual or virtual) after its encounter with the game implement are many and varied, the azimuth angle β plays an important role in determining whether the ball will go into the left, center or right field, whereas the elevation angle α has much to do, together with the exact point of impact of the ball on the surface of the implement 12 (which is round in the case of the bat), with the rate at which the ball is lifted (or grounded) after the impact, and hence with the distance traveled by the ball for a given speed of the implement 12.

The way the calculated values of the speed and various angles of the implement 12 are coordinated with the data signaling the parameters of approach movement of the pretend ball to obtain corresponding values for the movement of such ball after its encounter with the implement 12 is not the subject of the present invention and, hence, will not be discussed here in any detail. Suffice it to say that the trajectory of movement of the simulated ball after it had been hit by the implement 12 is calculated with a high degree of verisimilitude based on information obtained from actual playing of the game, so that the data obtained from the simulated (training) sessions have applicability to real-game situations and can be relied upon for training purposes with assurance that good results in training will be translated into equally good results in the field or on similar playing grounds.

It has been found in practice that the light intensity of the spatial sector is not uniform over its entire cross-section and, hence, the peak intensity may not be at the center line. In a currently preferred embodiment, it is known in advance exactly what the height, width and depth dimensions are of the spatial sector. The controller 30 (see FIG. 3) pulses each emitter in turn and receives a return signal from the respective sensor. If the bat 12 is not in the spatial sector, then there is no return signal or reflections.

As soon as the bat enters the spatial sector (see FIG. 4), an entry time $t_1$ is determined, because the controller notes the time when the return signal has been received. Similarly, as soon as the bat leaves the spatial sector, an exit time $t_2$ is determined, because the controller notes the time when the return signal is no longer being received.

Intermediate the entry and exit times, the controller is noting the light intensity level of the output signal for each measuring cycle (60 μsecs). If the current level is greater than the previous level, then the current level is stored as the "peak" level. In this way, it is assured that the maximum or peak level over the cross-section of the sector will be obtained.

This peak is then correlated with an elevation or height distance of the bat relative to the housing. This correlation can be generated by an algorithm, or preferably in a look-up table stored in a memory accessible to the controller 30.

The peak determines the height of the bat, and this height, together with the entry and exit times, is used to calculate the speed of the bat. Thus, one transceiver and light beam are used to determine both bat height and speed.

Figure 5:
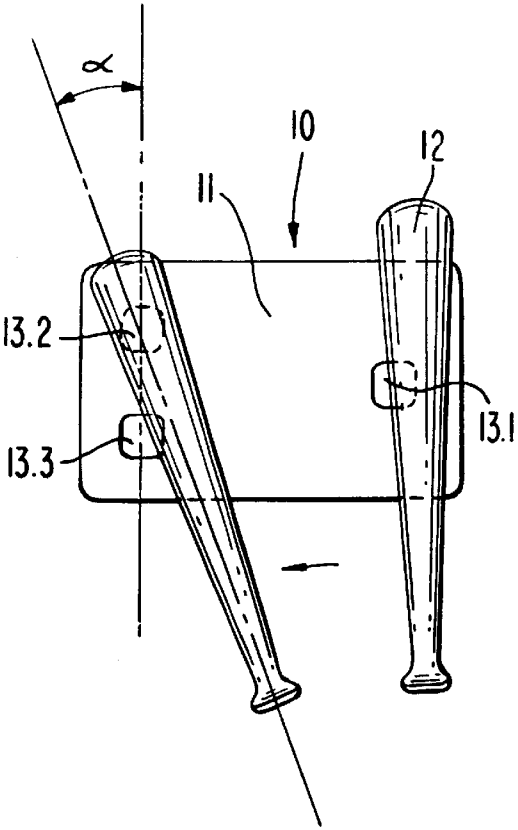
FIG. 5 is a top plan view showing in a somewhat simplified fashion a part of the arrangement of FIG. 1.

If two transceivers are used, such as transceivers 13.2 and 13.3 which are co-linearly arranged in a transverse row in FIG. 5, then the aforementioned azimuth and inclination angles α and β can also be determined.

If the two transceivers are co-linearly arranged, one forwardly of another, in a row, then the aforementioned elevation angle β can also be determined.

If three transceivers are arranged as shown in FIG. 5, then all three azimuth, elevation and inclination angles can be determined.

In another embodiment, a single transceiver can be used to not only determine the bat height as previously noted, but also whether the swing is upward or downward. The peak time is compared to the entry time. The closer the peak time is to the entry time, the more upward the angle of the swing. Conversely, the closer the peak time is to the exit time, the more downward the angle of the swing. If two transceivers are used in this embodiment, and are arranged in a row, such as transceivers 13.2 and 13.3, then all three aforementioned angles can be determined.

Turning now to FIG. 9, a player holds an opague bat 12' above a housing 11' in which three light emitters are arranged. In contrast to FIG. 1, the corresponding light sensors are not mounted on the housing, but instead, are mounted on an overhead support such as the ceiling or a batting cage.

As the bat 12' is swung, a shadow is cast over the field of view of the respective sensors. As before, the entry and exit times for the bat are determined as it enters and leaves each light beam. However, rather than determining the maximum or peak light intensity, the FIG. 9 embodiment measures the minimum or valley light intensity. As before, the same azimuth, inclination and elevation angles can be determined.

In another variant of the FIG. 9 embodiment, the sensors could be mounted alongside their respective emitters on the housing 11. In this case, reflectors would be mounted on the overhead support.

It will be understood that each of the elements described above, or two or more together, may also find a useful application in other types of constructions differing from the type described above.

While the present invention has been described and illustrated herein as embodied in a specific construction of apparatus for training baseball players in the proper use of the bat, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

We claim:

1. An arrangement for determining a path and a speed of movement of a moving implement, comprising:

a) a support;

b) means on the support for generating an optical spatial sector extending away from the support along a longitudinal direction, and having a cross-sectional dimension along a transverse direction normal to said longitudinal direction, said cross-sectional dimension being known along the longitudinal direction; and c) means for optically detecting a longitudinal distance of the moving implement relative to the support and a speed of the moving implement through the spatial sector, said detecting means including means for determining an entry time when the implement entered the spatial sector, an exit time when the implement exited the spatial sector, and a peak intensity of light located in the spatial sector and corresponding to the longitudinal distance relative to the support.

2. The arrangement as defined in claim 1, wherein the generating means includes a first light-emitting means for emitting at least one light beam.

3. The arrangement as defined in claim 2, and further comprising reflecting means associated with the implement, and wherein the detecting means includes photosensitive means on the support for sensing an intensity of light reflected by the reflecting means, and wherein said determining means is operative for determining a maximum peak of the intensity of the reflected light, said maximum peak intensity corresponding to the longitudinal distance of the implement relative to the support.

4. The arrangement as defined in claim 2, wherein the detecting means includes photosensitive means remote from the support for directly receiving the light beam, and wherein said determining means is operative for determining a minimum peak of the intensity of the light received by the photosensitive means and blocked by the implement, said minimum peak intensity corresponding to the longitudinal distance of the implement relative to the support.

5. The arrangement as defined in claim 3, wherein the generating means includes a second light-emitting means arranged in a row and spaced from the first light-emitting means, said first and second light-emitting means being operative for emitting first and second light beams spaced apart of each other.

6. The arrangement as defined in claim 5, wherein the generating means includes a third light-emitting means spaced transversely of the first and the second light-emitting means arranged in a row, said third light-emitting means being operative for emitting a third light beam spaced apart from the first and the second light beams, and wherein said determining means is operative for determining azimuth, elevation and inclination angles of the implement as the implement moves through the first, second and third light beams.

7. An arrangement in training players of a game during a simulated game session in a correct use of a game implement that has moved properly during an actual game to encounter an object and impart to the object a desired trajectory of movement after impacting the implement, comprising:

a) light-emitting means for emitting at least one initial and one subsequent detection light beam from respective predetermined locations into substantially vertically oriented respective spatial sectors;

b) reflecting means associated with the implement for reflecting light of the respective detection light beams back to the respective predetermined locations as the implement passes through the respective spatial sectors with an intensity that is in a predetermined functional relationship when reaching the respective predetermined locations to a distance of said reflecting means from the same predetermined location and to a degree of penetration of the reflecting means into the respective spatial sectors;

c) photosensitive means at each of the predetermined locations for sensing an intensity of the respective detection light returning to said respective predetermined locations only from said respective spatial sectors after having been reflected from said reflecting means during the passing of the implement through the respective spatial sectors; and d) evaluating means for detecting a peak of the intensity of the returning light and a time at which said peak had occurred for each spatial sector at each of the predetermined locations for determining respective distances of the implement from all of the predetermined locations and times of passage thereof past such predetermined locations and for determining various parameters of the movement of the implement including speed and various angles assumed thereby while moving in a path above the arrangement towards an object encounter location.

8. The arrangement as defined in claim 7, wherein there are two subsequent detection light beams, and wherein said predetermined locations are arranged at corners of a triangle on a housing.

9. The arrangement as defined in claim 8, wherein said housing has a low-profile configuration and has a base mounted on the ground.

10. The arrangement as defined in claim 8, wherein said light-emitting means is operative for emitting said light beams intermittently and in a predetermined sequence during a cycle of operation of the arrangement; and wherein said evaluation means includes means for holding a value of the detected intensity until a returned light intensity is detected again during a next following cycle.

11. The arrangement as defined in claim 10, wherein said evaluating means further includes means for comparing values of the detected intensity for each successive two of the cycles, and issuing a signal representative of a immediately previously detected light intensity once a comparison indicates a decrease in a detected intensity value.

12. The arrangement as defined in claim 7, wherein each spatial sector has an upwardly conically diverging configuration.

13. The arrangement as defined in claim 7, wherein the game implement is elongated, and wherein the reflecting means is located on an outer end region of the elongated implement.

14. The arrangement as defined in claim 7, and further comprising a display means for displaying an image of the object during the game session.

15. An arrangement for determining a path and a speed of movement of a moving implement, comprising:

a) a support;

b) means on the support for generating an optical spatial sector extending away from the support along a longitudinal direction, and having a cross-sectional dimension along a transverse direction normal to said longitudinal direction, said cross-sectional dimension being known along the longitudinal direction; and c) means for optically detecting a longitudinal distance of the moving implement relative to the support and the speed of a moving implement through the spatial sector, said detecting means including means for determining an entry time when the implement entered the spatial sector, and an exit time when the implement exited spatial sector, and means for taking multiple samples of the intensity of light along the transverse direction across the cross-sectional dimension to determine a peak intensity of light corresponding to the longitudinal distance relative to the support.

16. The arrangement as defined in claim 15, wherein said generating means includes a plurality of light-emitting means operative for emitting light beams intermittently and in a predetermined sequence during a cycle of operation of the arrangement; and wherein said taking means includes means for holding a value of a detected intensity until a returning light intensity is detected again during a next following cycle.

17. The arrangement as defined in claim 16, wherein said taking means further includes means for comparing values of the detected intensity for each successive two of the cycles, and issuing a signal representative of an immediately previously detected light intensity once a comparison indicates a decrease in a detected intensity value.

18. An arrangement for determining a path and a speed of movement of a moving implement, comprising:

a) a support;

b) means on the support for generating an optical spatial sector extending away from the support along a longitudinal direction, and having a cross-sectional dimension along a transverse direction normal to said longitudinal direction, said cross-sectional dimension being known along the longitudinal direction; and c) means for optically detecting a longitudinal distance and an angular orientation of the moving implement relative to the support and a speed of the moving implement through the spatial sector, said detecting means including means for determining an entry time when the implement entered the spatial sector, an exit time when the implement exited the spatial sector, a peak intensity of light corresponding to the longitudinal distance of the implement relative to the support, a peak time at which the peak intensity occurred, one angular orientation of the implement relative to the support when the peak time is closer to the entry time than the exit time, and a different angular orientation of the implement relative to the support when the peak time is closer to the exit time than the entry time.

* * * * *